United States Patent [19]

Roman et al.

[11] Patent Number: 4,925,390

[45] Date of Patent: May 15, 1990

[54] APPARATUS FOR RETAINING THE CONFIGURATION OF AN APERTURE FORMED THROUGH A COIL

[75] Inventors: Thomas J. Roman, Prophetstown, Ill.; Michael A. Ringle, Bettendorf, Iowa

[73] Assignee: Aluminum Company of America, Pittsburgh, Pa.

[21] Appl. No.: 323,105

[22] Filed: Mar. 10, 1989

Related U.S. Application Data

[60] Continuation of Ser. No. 215,421, Jul. 5, 1988, abandoned, Division of Ser. No. 88,296, Aug. 24, 1987, Pat. No. 4,293,801.

[51] Int. Cl.[5] ..... F27D 5/00; F27B 9/14

[52] U.S. Cl. ..... 432/247; 432/249; 432/5; 432/6

[58] Field of Search ..... 432/5, 6, 121, 134, 432/247, 249

[56] References Cited

U.S. PATENT DOCUMENTS 4,582,484 4/1986 Saudor ..... 432/11

4,786,249 11/1988 Kaji ..... 432/121

*Primary Examiner*—Henry C. Yuen

*Attorney, Agent, or Firm*—Elroy Strickland

[57] ABSTRACT

This invention relates to an apparatus and method for retaining the configuration of an aperture formed through a coil when the coil is supported on a saddle. The saddle has a pair of spaced apart upstanding legs. The apparatus includes a first and a second member, with the second member having a length sufficient to span the legs of the saddle. A pair of arms are pivotably attached to the first member and the arms are joined to the second member by a pair of links. The links enable the arms to move between a first position in which the arms are spaced inward and apart from the perimeter of the aperture when the second member is not in contact with the legs of the saddle and a second position in which the arms cooperate with the first member to support the weight of the coil when the second member is in contact with the legs of the saddle. The apparatus is particularly useful for supporting a coil during a heat treatment operation.

18 Claims, 4 Drawing Sheets

APPARATUS FOR RETAINING THE CONFIGURATION OF AN APERTURE FORMED THROUGH A COIL

This application is a continuation of application Ser. No. 215,421 filed July 5, 1988, now abandoned, which is a division of application Ser. No. 088,296 filed Aug. 24, 1987, now Pat. No. 4,973,801.

FIELD OF THE INVENTION

This invention relates to an apparatus and method for retaining the configuration of an aperture formed through a coil when the coil is supported on a saddle in preparation to be heat treated.

BACKGROUND OF THE INVENTION

In the process of manufacturing many types of metals, particularly aluminum, the metal is formed in long sheets before being rolled into coils. In rolling the metal into a coil, a temporary mandrel is used on a coiling machine. Upon removal of the coil from the machine, its central aperture is normally unsupported while the coil rests on the floor with the aperture positioned along a horizontal axis. In order to produce desired properties in the metal, it is normally subjected to a heat treatment operation, such as annealing, wherein the malleability or strength of the metal is altered. One method of heat treatment requires the huge coils to be tipped on end such that the central aperture has a vertical axis. The coils are then stacked on a movable tray and transported into a furnace where they are left for a period of time. Another method of heat treating metal coils is to unwind each coil and insert a temporary spool. However, many manufacturers shy away from this process for it requires an extra operation which necessitates more time and added expense. In either case, it is desirable to avoid handling or rotating the coils for such handling can cause nicks, mars or scratches in the surface finish.

Up until now, manufacturers have been unable to place metal coils in a heat treatment furnace with their central apertures aligned in a horizontal plane, because the weight of the coils would tend to cause the configuration of the aperture to deform. Such deformation can prevent the coil from being processed downstream wherein a temporary spool has to be inserted into the aperture in order for the coil to be unwound. Some U.S. patents which disclose solutions to this problem include Nos. 3,948,595; 3,846,190; and 2,601,443. All three relate to a hollow temporary spool or spider arrangement which is designed to retain the shape of the internal diameter of the coil. However, all necessitate the unwinding of the coil in order to remove the temporary spool.

Now an apparatus and method have been invented which has the capability of being inserted into the internal diameter of a coil and expanded so as to retain the aperture's configuration during heat treatment. The apparatus is also able to retract and be removed without unwinding the coil.

SUMMARY OF THE INVENTION

Briefly, this invention relates to an apparatus and method for retaining the configuration of an aperture formed through a coil when the coil is supported on a saddle. A saddle is a member having two spaced apart upstanding legs which is designed to hold a mandrel placed through the central aperture of a coil such that the aperture can be aligned in a horizontal plane. The apparatus which serves as the mandrel includes a first and a second member with the second member having a length sufficient to horizontally span the legs of the saddle. A pair of arm are pivotably attached to the first member. Both the first member and the arms have a surface which is approximately equal to a segment of the inner configuration of the aperture. For example, if the aperture is a circle, the surfaces of the first member and the pair of arms would be arcuate in shape. A pair of links join each of the arms to the second member. The links enable the arms to move between a first position in which the arms are spaced apart from the perimeter of the aperture when the second member is not in contact with the saddle and a second position in which the arms cooperate with the first member to support the coil when the second member is in contact with the saddle.

The general object of this invention is to provide an apparatus and method for retaining the configuration of an aperture formed through a coil of material. A more specific object of this invention is to provide a temporary means for preventing deformation of the internal diameter of a coil during heat treatment.

Another object of this invention is to provide a simple and inexpensive mechanism which can be inserted into the internal diameter of a coil and be expanded so as to support the coil and prevent the internal diameter from being deformed under the weight of the coil.

Still another object of this invention is to provide a method of inserting an apparatus into the central aperture of a coil and expanding the apparatus so as to retain the configuration of the aperture while the coil is subjected to heat treatment while retained on a horizontal axis.

A further object of this invention is to provide an apparatus and method for retaining the configuration of an aperture formed through a coil without the necessity of first unwinding the coil and then rewinding it onto a temporary spool.

Still further, an object of this invention is to provide an apparatus for retaining a coil along a horizontal axis during heat treatment without the need for upending the coil to be placed onto a movable tray which can then be transported into a furnace.

Other objects and advantages of the present invention will become more apparent to those skilled in the art in view of the following description and the accompanying drawings.

DETAILED DESCRIPTION OF THE PREFERRED EMBODIMENTS

Figure 1:
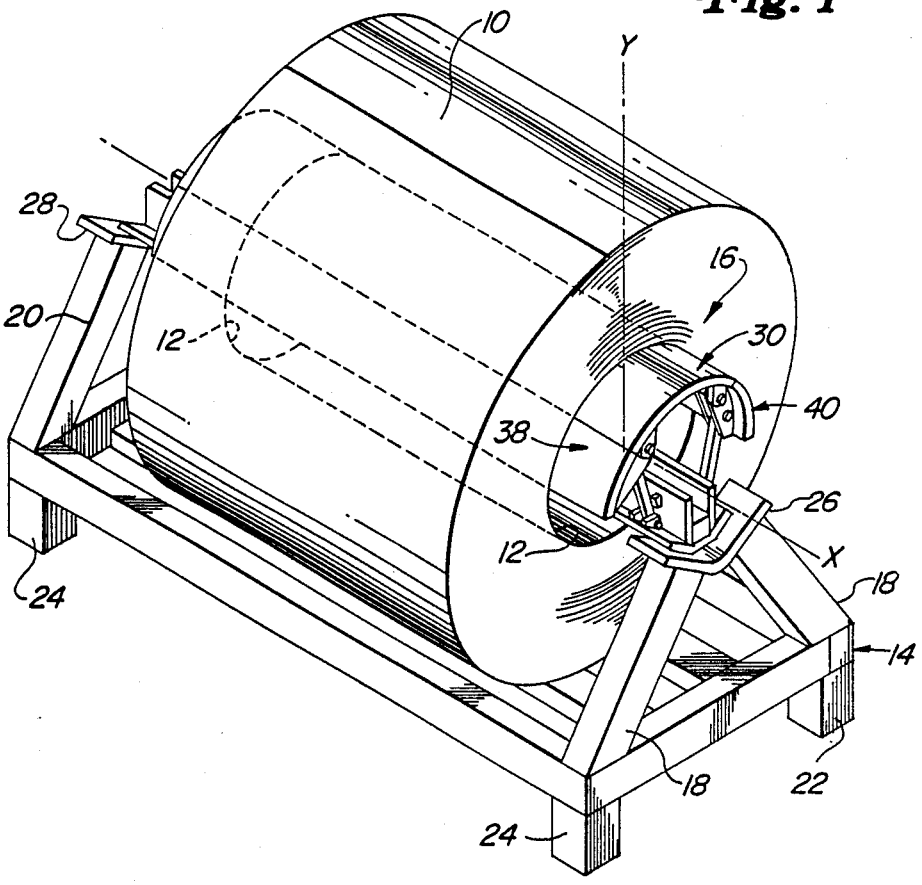
FIG. 1 is a perspective view of a coil of material having the apparatus of this invention inserted in its central aperture and being positioned on a horizontal axis and retained on a pair of spaced apart upstanding legs of a saddle.

Referring to FIG. 1, a coil of material 10 having a central aperture 12 formed therethrough is shown positioned on a saddle 14. The coil 10 which can be of any width or diameter can be wound in a winding machine from an elongated strip of material. The coil 10 can be a coil of aluminum, steel, other metals, metal alloy, paper, cloth, polyethylene, polypropylene, plastic, etc. In the case of aluminum, it is common to have a coil with a diameter up to 7 feet, a width of about 5 feet and an internal diameter of about 20 to 24 inches. Such a coil can weight anywhere between 20,000 and 40,000 pounds and normally must be subjected to a heat treatment operation such as annealing to obtain desired properties. By annealing aluminum to a temperature between 400° F. and 1000° F., preferably around 700° F. to 800° F., the aluminum can be heat treated to produce a harder material which has better wear resistance or a material which is more machineable.

It is preferred to orient the coil 10 along a horizontal axis indicated as X in FIG. 1. In order to orient the coil 10 along the horizontal axis, a temporary mandrel or apparatus 16 is inserted into the coil's inner diameter or aperture 12 so as to support the coil 10 between a pair of spaced apart upstanding legs 18 and 20 which are part of the saddle 14. The saddle 14 can also have a pair of spaced apart feet 22 and 24 which will facilitate the engagement of fork elements of a forklift truck thereunder so as to move the saddle 14 into and out of a heat treatment furnace. The saddle 14 can also be equipped with rollers or a chain attachment so that it can be drawn along a set path through a production facility. Preferably, the upper portions of the legs 18 and 20 have concave, C-, U- or V-shaped members 26 and 28, respectively, secured to them so as to facilitate retention of the apparatus 16.

Figure 2:
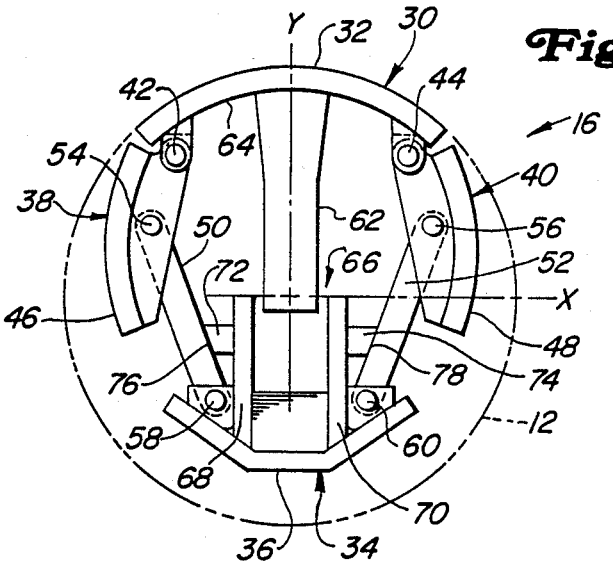
FIG. 2 is an end view of the apparatus resting on a hook and having its pair of arms folded inward away from the perimeter of the aperture formed through the coil.
Figure 3:
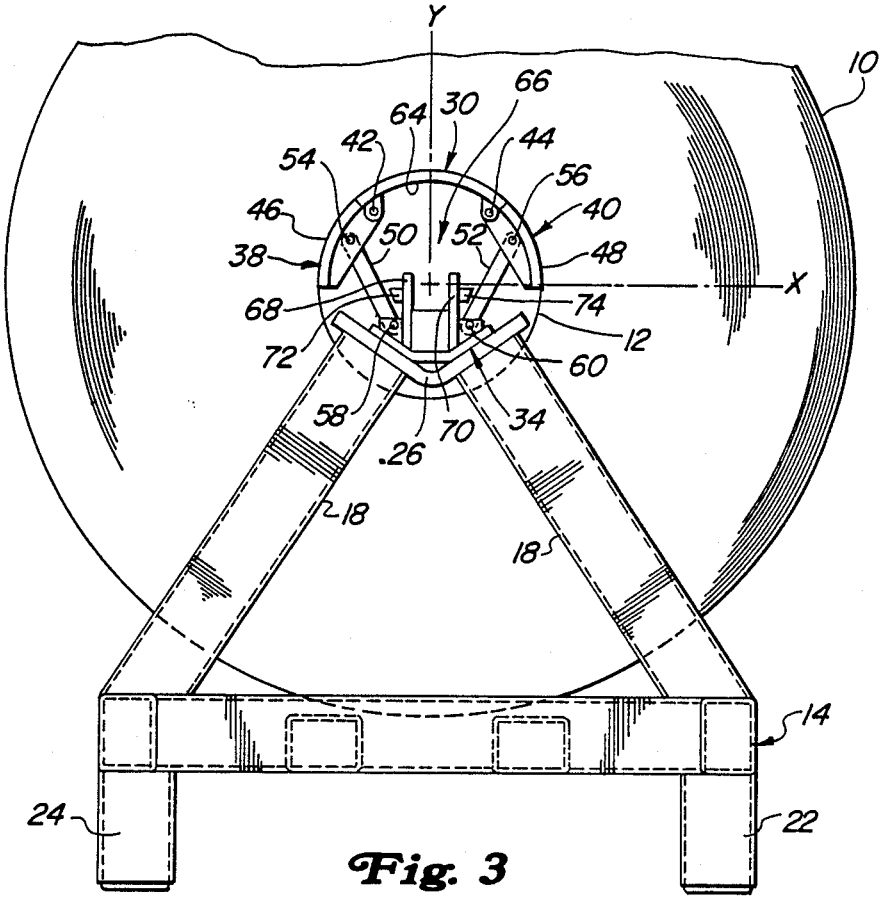
FIG. 3 is an end view of the apparatus positioned within a coil and mounted on a saddle showing the arms in the fully extended position.

Referring to FIGS. 2 and 3, the apparatus 16 is shown positioned within the aperture 12 of the coil 10. The apparatus 16, which can be constructed of ductile iron or Mechanile, has a first member 30 which preferably has a surface 32 which is approximately equal in configuration to a segment of the aperture 12. For example, if the aperture 12 is in the form of a circle, the surface 32 is an arcuate segment having a radius equal to the radius of the aperture 12. The length of the first member 30 is at least 60%, preferably 75%, and most preferably equal to the width of the coil 10. The length of the first member 30 can be longer than the width of the coil 10 for heavy material. The apparatus 16 also includes a second member 34 which is spaced apart from the first member 30 and has a length sufficient to span the pair of legs 18 and 20 of the saddle 14. The second member 34 contains a lower surface 36 which is configured to mate with the upper members 26 and 28 formed at the top of the legs 18 and 20, respectively. As shown in FIG. 2, the surface 16 has a horizontal member with two upwardly angled side members. As mentioned earlier, the second member 34 should extend beyond the width of the coil 10 a sufficient amount so as to contact and rest on the upper members 26 and 28. For a heavy coil of metal or aluminum, it is anticipated that the second member 34 should extend beyond the width of the coil 10 about 4 to 6 inches on each side.

A pair of arms 38 and 40 are pivotably attached at 42 and 44, respectively, to the first member 30. Each of the arms 38 and 40 has an outer surface 46 and 48, respectively which is approximately equal in configuration to a segment of the aperture 12 but which is smaller than the surface of the first member 30. For example, with a circular aperture 12, the other surfaces 46 and 48 would be arcuate segments which would be equal to a segment of the perimeter of the aperture 12. The arms 18 and 40 are pivotably attached between the first member 30 and the second member 34 by one or more pairs of links 50 and 12. The links are pivotably attached to the arms 38 and 40 at pivot points 54 and 56, respectively. Preferably, the pivot points 54 and 56 are located at approximately the longitudinal centers of the arms 38 and 40. The opposite ends of the arms 52 and 50 are pivotably attached at 58 and 60 to the second member 34. The links 50 and 52 enable the arms 38 and 40 to move between a first position, as shown in FIG. 2, wherein the respective surfaces 46 and 48 are spaced inward and away from the perimeter of the aperture 12. This inward or retracted position occurs when the second member 34 is not in contact with the legs 18 and 20 of the saddle 14 and facilitates the insertion of the apparatus 16 into the aperture 12. The links 50 and 52 also provide a means for expanding or moving the arms 38 and 40 outward such that the come in contact with the perimeter of the aperture 12 as is shown in FIG. 3. In this outward or second position, the respective surfaces 46 and 48 of the arms 38 and 40 will contact the inner diameter of the coil 10 and cooperate with the first member 30 to provide support for the coil's weight. The second position occurs when the second member contacts the upper members 26 and 28 of the saddle 14 and enables the weight of the coil 10 to push downward on the first member 30 while the second member 34 is held stationary.

In operation a hook 62, such as a C-hook attached to a hydraulic or pneumatic boom or a fork element of a forklift truck, is inserted into the aperture 12 so that it contacts a lower surface 64 of the first member 30. To assist is positioning the hook 62 along the vertical axis denoted Y in FIG. 2, a channel 66 consisting of two upstanding and spaced apart legs 68 and 70 is secured such as by welding to the second member 14. The channel 66 assists in aligning the hook 62 in the middle of the aperture 12 and will prevent damage to the components by preventing the hook 62 from bumping the arms 38 and 40 or the pivots 42 and 44. Preferably, the hook 62 is inserted into the aperture 12 such that it extends inward at least 50 of the length of the first member 30 so as to be able to lift the apparatus 16 and coil 10 upward in a horizontal manner. As the hook 62 lifts the apparatus 16 up off the floor or a stand, the arms 38 and 40 will pivot inward to their first position. The first position can be precisely determined by using a pair of stops 72 and 74 which are secured to the outer surface of the legs 68 and 70, respectively. The stops 72 and 74 have inclined surfaces 76 and 78, respectively, which will mate flush with the outer surface of the arms 50 and 52 so as to limit their movement. The stops 72 and 74 also prevent the arms 38 and 40 and the links 50 and 52 from swinging inward beyond a vertical line drawn through the pivots 42 and 44. If the stops 72 and 74 are not present, it could be possible for the links 50 and 52 and the arms 38 and 40 to swing further inward as weight is placed on the first member 30 such that it would damage the apparatus. 16.

The outward movement of the arms 38 and 40 will be restricted as their respective arcuate segments abut the ends of the first member 30. For this reason, the apparatus 16 should be designed so as to accommodate set diameter apertures. For example, the apparatus 16 can be designed for as aperture 12 having an inner diameter of 20 inches. In this case the configuration of the surface 32 and the surfaces 46 and 48 on the arms 38 and 40, respectively, will be able to accommodate a coil 10 having an inner diameter of 20 inches or a slightly smaller or larger diameter, for example 19 or 21 inches, but should not be used on a coil having a diameter of 24 inches. The reason for this is that the apparatus 16 is designed to retain the circular configuration of a circular aperture 12 formed on the inner diameter of the coil 10, especially during a heat treatment operation. If the apparatus 16 is not sized to the correct aperture 12, then it is possible that the aperture 12 could be deformed into an elliptical or egg-shaped configuration which would defeat the purpose of this invention.

The apparatus 16 can be constructed out of cold rolled steel, ductile iron, cast iron or other types of malleable material which have a desired hardness and can be subjected to a heat treatment operation.

Figure 4:
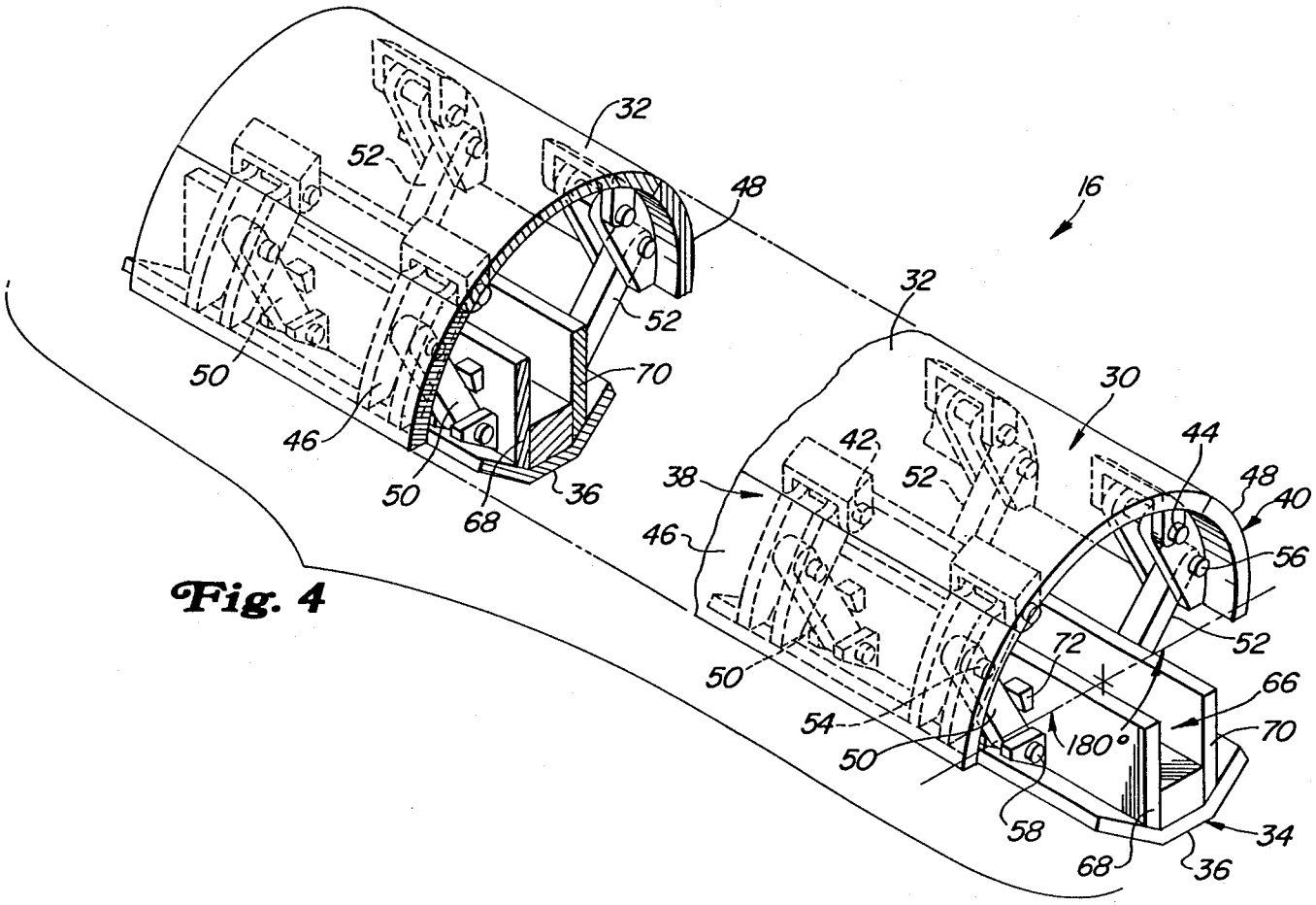
FIG. 4 is a perspective view of the apparatus showing a plurality of pairs of links spaced along its length which join the arms to the second member.

Referring to FIG. 4, one can see that there are several pairs of links 50 and 52 spaced along the length of the apparatus 16. The pairs of links 50 and 52 can be spaced depending upon the weight and width of the coil 10. For a large coil of aluminum having a diameter of 6 feet or greater, it is advantageous to arrange the pairs of links 50 and 52 about every 6 inches along the length of the apparatus 16. FIG. 4 also shows that the combined total surface of the first member 30 and the arms 38 and 40 will provide as arcuate segment which is slightly greater than 180°. For example, the first member 30 can have an arcuate segment which spans about 120° and each arm 38 and 40 can have an arcuate segment which extends about 30° or 40° over the perimeter of the aperture 12. When the first member 30 and the arms 38 and 40 combine to form an arcuate segment which is at least half of the perimeter of the aperture 12, one can be assured of retaining the configuration of the aperture 12 regardless of the weight of the coil 10 or the length or temperature of the heat treatment operation.

Figure 5:
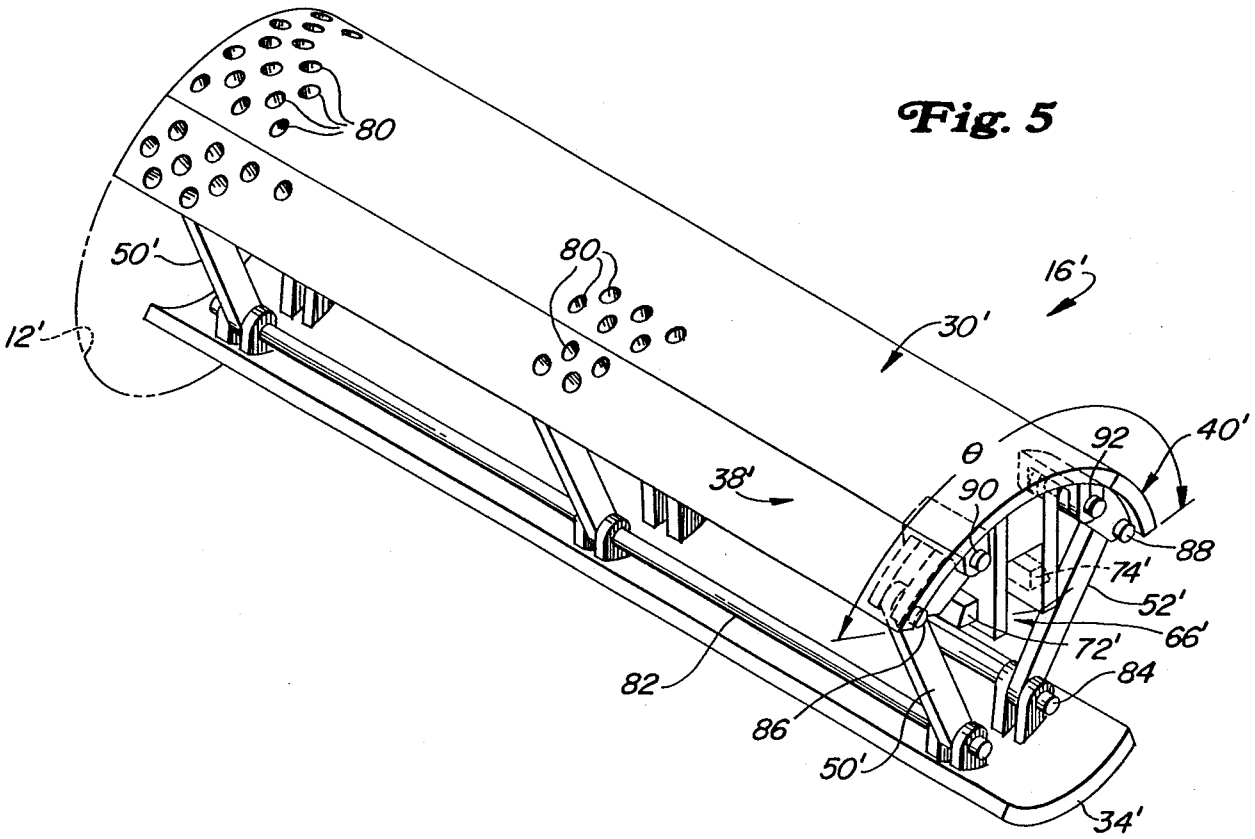
FIG. 5 is an alternative embodiment of the apparatus showing the arcuate segment formed by the first member and the pair of arms to be an angle theta and having a plurality of openings formed in both the first member and arms to facilitate circulation of heat to the inner diameter of the coil.

Referring to FIG. 5, an alternative embodiment 16' is depicted. For convenience's sake, the numbers are identical to those listed in FIGS. 1 through 4 except that they are prime. The first member 30' and the arms 38' and 40' have a plurality of openings 80 formed therethrough which facilitate the circulation of heat during a heat treatment operation. The openings 80 can be constructed in a random or uniform pattern throughout a portion of or over the entire length of the apparatus 16'. The apparatus 16' also has a smaller arcuate segment produced by the first member 30' and the pair of arms 38' and 40'. As shown, the arcuate segment is denoted by an angle theta $\theta$ which is less than half of the circumference of the aperture 12'. The angle theta $\theta$ can be between about 90° and 180° but is preferably equal to at least 120% of the circumference of the aperture 12'. By decreasing the length of the arcuate segment and by providing the openings 80, one can facilitate the contact of heat on the inner diameter of the coil 10.

The apparatus 16' also differs from the first embodiment in that the channel 66 is secured to the first member 30' instead of the second member 34'. This puts the stops 72' and 74' in alignment with the pair of arms 38' and 40'. Due to the length of the apparatus 16', rods 82 and 84 are used to replace the pins joining the links 50' and 52' to the second member 34'. Likewise, rods 86, 88, 90 and 92 can be used in place of the pins at the other pivot connections.

The method of retaining the configuration of an aperture 12 formed through a coil 10 is as follows. With the coil 10 resting on the floor with its aperture positioned along a horizontal axis, the apparatus 16 is positioned on a lifting mechanism such as a C-hook 62. The apparatus 16 is moved into alignment with the aperture 12 formed in the coil 10 and is inserted therein while the arms 38 and 40 are located in their retracted position, see FIG. 2. The coil 10 and apparatus 16 are then lifted and positioned onto the saddle 14 and lowered such that the second member 34 spans the pair to upstanding legs 18 and 20, and the apparatus 16 is horizontally positioned therebetween. As the second member 34 contacts the upper members 26 and 28 of the legs 18 and 20, respectively, it becomes stationary. As the hook 62 is lowered, the weight of the coil 10 exerts a force on the first member 30 cassing it to move downward such that the links 50 and 52 pivot outward forcing the arms 38 and 40 to come in contact with the perimeter of the aperture 12. At this point, the arms 38 and 40 are in their -second or extended position and are capable of supporting the weight of the coil 10. The C-hook 62 is then lowered away from the inner surface 64 of the first member 30 and is withdrawn from the apparatus 16 being guided by the channel 66. The coil 10 is now retained along the horizontal axis on the saddle 14 and can be moved to various operations including into a heat treatment furnace. By retaining the coil on a horizontal axis mounted on the saddle 14, the coil 10 can be moved to various operations without the need of upending or unwinding the coil. The apparatus 16 also facilitates the transport of the coil 10 onto a semi-circular shaped saddle such that the weight of the coil 10 is supported by its outside diameter. This enables the apparatus 16 to be removed and allows a temporary spool or mandrel to be inserted into the aperture 12. This can occur after a heat treatment operation wherein the coil 10 is to be placed on an unwinding machine or a stripping machine such that the surfaces of the coil can be coated or the edges of the coil trimmed.

While the invention has been described in conjunction with two specific embodiments, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

We claim:

1. An apparatus for retaining the configuration of an aperture formed through a coil when said coil is supported on a saddle, said apparatus comprising:

(a) a first and a second member, said second member having a length sufficient to span said saddle;

(b) arm means pivotably attached to said first member; and (c) joining means for joining each of said arm means to said second member, said joining means enabling said arm means to move between a first position in which said arm means are spaced apart from the perimeter of said aperture when said second member is not in contact with said saddle and a second position in which said arm means cooperate with said first member to support said coil when said second member is in contact with said saddle.

2. The apparatus of claim 1 wherein said joining means includes a pair of links pivotably attached between said arm means and said second member.

3. The apparatus of claim 2 wherein stops are formed on said second member which limit the movement of said links in one direction.

4. The apparatus of claim 2 wherein a channel is formed on said second member which facilitates the insertion of a C-hook between said first and second members.

5. The apparatus of claim 1 wherein said aperture is circular and said first member and said arm means contain arcuate surfaces approximately equal to an arcuate segment of said aperture.

6. The apparatus of claim 5 wherein said arm means include a pair of arms which cooperate with said first member when in their second position to provide an arcuate segment having a length which is equal to at least 90% of the circumference of said aperture.

7. The apparatus of claim 6 wherein said pair of arms cooperate with said first member when in their second position to provide an arcuate segment having a length which is equal to at least 120% of the circumference of said aperture.

8. The apparatus of claim 7 wherein said pair of arms cooperate with said first member when in their second position to provide an arcuate segment having a length which is equal to at least 180% of the circumference of said aperture.

9. The apparatus of claim 1 wherein a plurality of openings are formed through said first member and each of said arm means to facilitate circulation of heat to the inner periphery of said coil.

10. An apparatus for retaining the configuration of an aperture formed through the center of a coil of material when said coil is supported on a saddle along a horizontal axis, said apparatus comprising:

(a) a first member having a surface approximately equal in configuration to a segment of said aperture and having a length sufficient to support said coil;

(b) a second member spaced apart from said first member and having a length sufficient to span said saddle;

(c) a pair of arms pivotably attached to said first member, each arm having a surface approximately equal in configuration to a segment of said aperture; and (d) means for joining each of said arms to said second member, said means enabling said arms to move between a first position in which said respective surfaces are spaced apart from the perimeter of said aperture when said second member is not in contact with said saddle and a second position in which said respective surfaces cooperate with said first member to support said coil when said second member is in contact with said saddle.

11. The apparatus of claim 10 wherein said means includes a pair of links pivotably attached between said pair of arms and said second member.

12. The apparatus of claim 11 wherein at least two pair of links join said first member to said second member.

13. The apparatus of claim 10 wherein stops are formed on either said first or second member which limit the movement of said links in one direction.

14. The apparatus of claim 10 wherein a plurality of openings are formed through said surfaces of said first member and said arms respectively to facilitate circulation of that to the inner periphery of said coil.

15. The apparatus of claim 10 wherein said surfaces of said first member and said pair of arms cooperate to provide a combined surface equal to at leas tone-half of the perimeter of said aperture.

16. The apparatus of claim 10 wherein said surface of said first member is greater than said surface of either arm.

17. The apparatus of claim 10 wherein each arm has a surface of equal length.

18. An apparatus for retaining the configuration of a circular aperture formed through he center of a coil of material when the weight of said coil is supported on a saddle along a horizontal axis, said apparatus comprising:

(a) a first member having an arcuate surface approximately equal to an arcuate segment of said aperture and having a length equal to at least 75% of the width of said coil;

(b) a second member spaced apart from said first member and having a length sufficient to span said saddle;

(c) a pair of arms pivotably attached to said first member, each harm having an arcuate surface approximately equal to an arcuate segment of said aperture; and (d) a pair of links pivotably attached between said pair of arms and said second member, said links enabling said arms to move between a first position in which said respective surfaces are spaced apart from the perimeter of said aperture when said second member is not in contact with said saddle and a second position in which said respective surfaces cooperate with said first member to contact and support said coil when said second member is in contact with said saddle.

* * * * *

UNITED STATES PATENT AND TRADEMARK OFFICE

CERTIFICATE OF CORRECTION

PATENT NO. : 4,925,390

DATED : May 15, 1990

INVENTOR(S) : Thomas J. Roman et al.

It is certified that error appears in the above-identified patent and that said Letters Patent is hereby corrected as shown below:

| | |
|---|---|
| Col. 3, line 64 | Change "surface 16" to --surface 36--. |
| Col. 4, line 12 | Change "arms 18 and 40" to --arms 38 and 40--. |
| Col. 4, line 15 | Change "50 and 12" to --50 and 52--. |
| Col. 4, line 19 | Change "52 and 50" to --52 and 54--. |
| Col. 4, line 42 | Change "of a forklift" to --on a forklift--. |
| Col. 4, line 48 | Change "second member 14" to --second member 34--. |
| Col. 4, line 54 | Change "50" to --50%--. |
| Col. 5, line 9 | Change "designed for as" to --designed for an--. |
| Col. 6, line 18 | Change "pair to" to --pair of--. |
| Col. 6, line 24 | Change "cassing it" to --causing it--. |

UNITED STATES PATENT AND TRADEMARK OFFICE

CERTIFICATE OF CORRECTION

PATENT NO. : 4,925,390

DATED : May 15, 1990

INVENTOR(S) : Thomas J. Roman et al.

It is certified that error appears in the above-identified patent and that said Letters Patent is hereby corrected as shown below:

| | |
|---|---|
| Col. 8, line 10<br>Claim 12 | Change "pair of links" to --pairs of links--. |
| Col. 8, line 18<br>Claim 14 | Change "circulation of that" to --circulation of heat--. |
| Col. 8, line 21<br>Claim 15 | Change "leas tone-half" to --least one-half--. |
| Col. 8, line 29<br>Claim 18 | Change "formed through he" to --formed through the--. |
| Col. 8, line 41<br>Claim 18 | Change "each harm having" to --each arm having--. |

Signed and Sealed this

Fifth Day of November, 1991

*Attest:*

HARRY F. MANBECK, JR.

*Attesting Officer*

*Commissioner of Patents and Trademarks*